US006299518B1

(12) United States Patent
Daggett

(10) Patent No.: US 6,299,518 B1
(45) Date of Patent: Oct. 9, 2001

(54) ROTARY ABRASION DEVICE

(76) Inventor: Thomas H. Daggett, 755 Boothbay Rd., Edgecomb, ME (US) 04556

( * ) Notice: Subject to any disclaimer, the term of this patent is extended or adjusted under 35 U.S.C. 154(b) by 0 days.

(21) Appl. No.: 09/250,534

(22) Filed: Feb. 16, 1999

(51) Int. Cl.[7] ..... B24B 23/00

(52) U.S. Cl. ..... 451/344; 110/194; 110/358; 110/415; 110/424; 110/348

(58) Field of Search ..... 451/194, 195, 451/197, 358, 360, 415, 418, 424, 344, 348, 103, 110

(56) References Cited

U.S. PATENT DOCUMENTS 3,621,505 * 11/1971 Vocker et al. ..... 451/358
5,016,398 * 5/1991 Fukunaga ..... 451/358
5,251,407 * 10/1993 Afshar ..... 451/358
5,941,764 * 8/1999 Yang ..... 451/358
5,967,887 * 10/1999 Synowski ..... 451/358

* cited by examiner

*Primary Examiner*—Eileen P. Morgan
(74) *Attorney, Agent, or Firm*—Pandiscio & Pandiscio

(57) ABSTRACT

A rotary abrasion device that includes an axial shaft adapted to be attached to a fixed or keyed power tool chuck. The device has standardized shaft element, preferably a hex shank, located along a central longitudinal axis. This shank is common to the three primary embodiments. One embodiment includes an inner cylinder with apertures that allow a peripheral arrangement of brushes to protrude through the inner cylinder. Metallic pipes, tubing, and the like are able to be placed into the inner cylinder. An adjustment element on the device limits brush protrusion into the inner cylinder and thus the brush contact with any metallic pipe inserted within the inner cylinder. Rotation of the device is accomplished via the given power tool so as to abrade the given metallic pipe. One alternative embodiment includes an additional central reamer element placed within the inner cylinder and secured within the axial shaft of the device. Another alternative embodiment utilizes a singular brush without the inner cylinder or adjustment element, but with the axial shaft common to the other embodiments.

15 Claims, 12 Drawing Sheets

ROTARY ABRASION DEVICE

BACKGROUND OF THE INVENTION

1. Field of Invention

The present invention relates generally to the field of devices for deburring and cleaning metallic structures. More particularly, the present invention relates to a device for providing surface preparation for metallic structures such as piping and tubing. More particular yet, the present invention involves an attachment for a rotary power tool, where the attachment is a rotary abrasion device that cleans the outside of the end of a pipe or tube in preparation for soldering or welding procedures. As well, the rotary abrasion device can be utilized for inner-surface preparation—e.g., reaming and cleaning the inside of the same end of piping and tubing.

2. Description of Prior-art

While the general field of metalworking with piping and tubing involves problems associated with removal of oxide build-up and surface irregularities (e.g., burrs, nicks, cuts), the more specific field of pipefitting will be discussed. It should be noted that this discussion is limited to the specific field of pipefitting for the sole purpose of illustrative clarity and is not meant to limit the intended scope of the invention.

In the field of pipefitting, the general operation for soldering pipes together begins with the process of cutting a pipe to length. Typically, pipe cutters are used. These cutters are well known in the art and are generally C-shaped and include a cutting wheel at one end and bearings at the other end. The pipe is positioned within the cutter between the cutter's ends and tightened so that the cutting wheel and the bearings come into contact with the outer surface of the pipe. The cutter is then rotated around the pipe while the cutter is increasingly tightened. The cutting wheel cuts deeper into the piping with each turn of the cutter. This process continues until the piping is eventually cut through where the cutting wheel made contact. This common cutting process yields at least two undesirable effects.

Cutting pipes in the field of pipefitting creates undesirable metal burrs along the inner surface at the cut edge of the pipe, and slightly decreases the diameter of the pipe at the cut edge. Any such irregularities in the pipe can affect the flow of whatever fluid (e.g., refrigerants, water, . . . etc.) is used within the finished system (e.g., HVAC, hot water heater plumbing, heat pump system, . . . etc.). Additionally, metal burrs that are not removed can break off and foul any machinery and apparatus (e.g., pumps, sensors, heating elements, . . . etc.) that are incorporated into the finished system. In addition to the problems related to the piping's inner surfaces, exposed surfaces of metallic piping are often subject to oxidation. This is particularly acute with respect to copper piping where the oxides that naturally form on the pipe's outer surface must be removed to enable a secure fit and weld. It is common that using a pipe cutter also reduces the diameter of the pipe at the very end and may leave excess material (i.e., burrs) on the edges of the cut. If not properly removed, any subsequent weld will be weak and subject to increased chance of leakage. Further, excess material such as copper filings and burrs within a domestic hot water heating system can encourage undesirable calcifications within the pipes requiring costly repair or replacement of pipes.

In operation after the pipe has been cut to length, a pipefitter will typically use a manual reamer to cut away burrs from the cut edge and to widen the mouth of the pipe opening back to its original diameter. This includes preparation of the inner surface of the piece having the wider diameter as well as the outer surface of the piece to be soldered or brazed thereon. The preparation of the surfaces typically involves abrading the surfaces to be joined with an abrasive means. Conventionally, this is accomplished manually using either sandpaper of a suitable rugosity for metal or hand-held wire bristles. Such manual brushes are typically worn and misshapen beyond repair after extended use and then become unwanted trash. After the outer and inner surfaces near the cut edge of the pipe are manually provided with an oxide-free, shiny appearance, the pipefitter applies flux or a similar solder-drawing compound onto the cleaned portions of tubing to be soldered and pushes one into the other. Heat is then applied and followed by solder. The workpiece is cooled so as to allow the drawn-in solder to harden and form a fluid tight joint.

From the operation described above, it becomes critically apparent that proper surface preparation occurs prior to the soldering or brazing. This includes the requirements that the cut end of the pipe be restored to its full diameter, the exposed surfaces be free from any oxidation, and that any excess material or burrs along the cut must be removed. In the past, the widening has been accomplished by the separate step of reaming the cut end on its inner surface with a reaming tool while the removal of any burrs and oxidation was accomplished via sandpaper or some wire bristles. Among the prior-art references, several known devices typify the aforementioned pipe preparation tools and some attempt to alleviate the problems associated with manual reaming and deburring. However, none of these below patents touch the disclosure of this invention as described herein.

The device of U.S. Pat. No. 5,168,660 issued to Smith is an attachment for an existing drill that includes two or three brushes. The brushes are spring-biased to press against a pipe upon insertion. However, this device is entirely lacking any pipe guides or brush-limiting mechanisms that would prevent excessive wear of the brushes if the pipe were twisted off its ideal axial placement.

The device of U.S. Pat. No. 4,862,549 issued to Criswell et al. is an attachment for an existing drill consisting of an internal brush for cleaning of fittings and an external brush for cleaning of tubes prior to soldering that are provided in a single attachment that may be driven by either a manual or motor driven means. However, the device of Criswell et al. fails to provide any structure to maintain a pipe's end aligned while limiting deformation and wearing.

The device of U.S. Pat. No. 4,467,489 issued to Begneaud is a complex drill attachment that includes a brush device that is either manually operated or motor driven for cleaning the threads of bolts and studs and threaded pipe ends using combinations of bristles and solvent or air application.

The device of U.S. Pat. No. 4,014,062 issued to Scott et al. is a pipe-cleaning device that includes three rotating brushes and requires an Allen wrench to move each brush. As well, no inner cylindrical guide is present to align the pipe and prevent excessive wear of the brushes.

The device of U.S. Pat. No. 3,820,184 issued to Stone is a whole-pipe-cleaning device that includes multiple rotating brushes. There is no inner cylinder that would guide the pipe and maintain its alignment during use. This would lead to excessive brush wear and subsequent brush failure.

The device of U.S. Pat. No. 3,188,674 issued to Hobbs is a rotary tube end cleaner which is essentially a socket or cylindrical housing having a cylindrical inner surface lined with an abrasive material such as wire bristles, sandpaper and the like. The socket can be mounted to an electric drill and is provided with adjustment screws for changing the distance between the oppositely facing abrasive surfaces, thereby permitting adjustment for varying diameters of piping.

The device of U.S. Pat. No. 2,866,212 issued to White et al. is a pipe-cleaning device that includes a mechanism for cleaning both the inner and outer pipe surfaces. A significant problem with the design of this device is that any cleaning of the outer pipe surface may not be uniform. Indeed, the pipe is likely to be brushed in such a way that longitudinal ruts jeopardize the pipe thickness.

The device of U.S. Pat. No. 2,635,393 issued to Barth is a pipe-cleaning device that includes centrifugally-actuated brushes. This device fails to provide any limit for brush actuation against the pipe surface other than the brush itself such that this design will result in fast wearing brushes. While a boss element is shown that attempts to align the given pipe, the boss element fails to support the entire inserted length of the pipe and does not prevent twisting of the pipe during use. Thus, pipe thickness will be subject to uneven wear and gouging.

None of the patents discussed above adequately provides for accurately reaming the end of a cut pipe to remove all excess material (i.e., deburring) while also abrasively cleaning the surface to be welded. Common to many of the prior-art devices, reaming and deburring is a prerequisite operation. That is to say, reaming and deburring is performed prior to the application of the prior-art devices for abrasively cleaning the pipe surfaces that are to be welded. None of the prior-art devices teach or render obvious the rotary abrasion device of the present invention wherein the insertion of a pipe end into a single tool and operation thereof accurately and efficiently accomplishes reaming of the cut end of the pipe, removal of any excess material, and abrasive cleaning of the welding surfaces.

Contemporary improvements in these prior-art devices have been limited to a cumbersome design that fails to produce uniform and efficient surface preparation of pipes. The prior-art devices do not provide any compensation for unwanted twisting of the pipe within the given cleaning device. This will directly result in undesirable deformation of the abrasive means (e.g., brushes) and ultimately requires early replacement of the worn brushes. As the prior-art fails to maintain a pipe's end in a centered position during cleaning, the uneven and excessive wearing of the brushes requires frequent replacement that is both costly and time consuming. Further, this inability of the prior-art to adequately secure the pipe's end creates a significant problem in that any cleaning of the welding surface may not be uniform. Indeed, the pipe is likely to be brushed in such a way that non-uniform marks and ruts jeopardize the pipe thickness Accordingly, it is desirable to provide for a new and improved, effective rotary abrasion device for providing proper surface preparation suitable for metal-working purposes such as, but not limited to, copper piping installation. What is needed is such a rotary abrasion device that is easily operated. What is also needed is such a rotary abrasion device that can utilize old, worn, and normally-discarded manual brushes. What is further needed is such a rotary abrasion device that does not require specialized actuation means, but instead can be used in any hand-held power tool (e.g., drills, cordless screwdrivers, multipurpose rotary devices, and the like). Still, what is needed is such a rotary abrasion device that keeps a pipe's end stabilized and aligned within the device thereby preventing any non-uniform pipe marks or ruts that would jeopardize the wall thickness of the pipe. What is also needed is such a rotary abrasion device that includes an inner cylindrical guide that efficiently operates to both maintain the pipe's end therewithin in stable alignment and automatically limits brush abrasiveness. Still further, what is needed is such a rotary abrasion device that provides an automatic brush adjustment feature which requires few mechanical parts. Yet still further, what is needed is such a rotary abrasion device which overcomes at least some of the disadvantages of the prior-art while providing new and useful self-aligning and brush-wear-limiting features.

SUMMARY OF THE INVENTION

It is an objective of the present invention to provide a rotary abrasion device that provides fast and easy surface preparation suitable for metal-working purposes such as, but not limited to, copper piping installation. It is another objective of the present invention to provide a rotary abrasion device that is easily operated by common actuation means found in any hand-held power tool (e.g., keyed or keyless drills, cordless screwdrivers, multipurpose rotary devices, and the like). Still another objective of the present invention is to provide a rotary abrasion device that keeps a pipe's end stabilized and centered within the device thereby preventing any non-uniform marks or ruts that would reduce the pipe's wall thickness, and thus durability, of the pipe. It is an objective of the present invention to provide a rotary abrasion device that reuses old, worn, and normally-discarded manual wire-brushes. Another objective of the present invention is to provide a rotary abrasion device that includes an inner cylindrical guide that efficiently operates to both maintain the pipe's end therewithin in stable alignment and automatically limits brush abrasiveness. Such pipe-aligning/self-limitingbrush feature being uniquely designed so as to require few mechanical parts. Yet another objective of the present invention is to provide a rotary abrasion device that includes automatic brush adjustment by way of radial spring means.

The present invention is directed to a rotary abrasion device useful for brushing and reaming pipe ends such as, but not limited to, copper plumbing. Several industries such as heating, plumbing, and HVAC are intended beneficiaries of the instant invention. It is desirable that the rotary abrasion device of the current invention be fabricated from durable and hard materials—e.g., steel, titanium, or some metal alloy having similar physical qualities. While metals are preferred, it should be understood that equally durable materials such as carbon fiber composites and the like could also be utilized without straying from the intended scope of the present invention.

The rotary abrasion device includes an axial shaft that is adapted to be attached to a power tool chuck. The shaft itself is formed in a standard shape that is accepted by chucks of one or more types of hand-held rotary tools. These chucks may be keyed or keyless. While the contemporary standard for keyless chucks accommodates hexagonal shanks, it should be understood that any suitably secure, standardized shank can be utilized. Such tools include, without limitation, drills, screwdrivers, and any other similar multiuse rotary device whether electric, gas, pneumatic, or otherwise alternatively powered. The axial shaft includes integral lugs upon which a base plate is situated. The shaft also has a central bore that accepts an optional reamer element. The base plate includes apertures that accept the lugs. As well, the base plate includes brush slots into which brushes may be fixedly or slidably affixed. The brushes can be high-carbon steel (or any suitably durable) brushes mounted on twisted wire where the twisted wire ends are crimped into each brush slot. The brushes would be readily available as replacement brushes from any retail store (e.g., Hardware, Home Improvement Center, . . . etc.) for the present invention. Still further, the old, worn, and normally-discarded brushes can be used equally as effectively. This advantageous re-use of old brushes is a notable feature of the present invention.

By using brushes with twisted wire mountings, flexibility of the brush stem is assured. Alternatively, the twisted wire ends can include molded support elements that snap, screw, or otherwise securely fit into the brush slot. The twisted wire of each brush that is placed into each brush slot is able to move radially with respect to the axis of rotation. While any number of brushes may be used, the given arrangement should be symmetrical—e.g., equidistantly placed in a circular pattern—to assure proper rotation of the overall rotary abrasion device.

The base plate also includes an integrated inner rotary sleeve that may be formed with the base plate by some metal forming method (e.g., casting, lathe-worked, . . . etc.) or formed separately and then welded or bonded in some fixed manner to the base plate. The inner rotary sleeve extends from the base plate and includes longitudinal orifices. These orifices within the inner rotary sleeve allow each brush to project radially into the tubular space within the inner rotary sleeve. However, the brushes are physically limited in how far they can radially project into the inner rotary sleeve. As well, the brushes are adjustable in how far they project via an adjustment means. The adjustment means includes several types: an outer circular banding with a screw-type tightener or jackscrew, compression-springs located between an outer circumferential wall and each brush, or any similar adjustment means. The important aspect of any such adjustment means is that it allows pressure directed radially and inwardly against the central portion of each brush so that the central portion is forced through its related orifice and into the tubular space within the inner sleeve.

In its most basic form, the instant invention may include a single brush mounted on the axial shaft. This alternative embodiment would involve casting a solid standardized shaft (e.g., hex shank) from a suitably durable metal (e.g., steel, titanium, or lead, tin or zinc alloys, and the like) around the stem of each individual brush. This enables the brush to be inserted into any existing drill chuck. Not only would this increase the speed of cleaning, but also the useful life of the brush would be extended much longer than similar hand-held brushes. Such a modified brush would clean several times more fittings before being considered no longer effective. This is due to the fact that manual wrist-action typically covers twisting 180 degrees. Yet still, once the manual-type brush wears to the point that it no longer firmly fits inside the fitting, the user must push such a brush to one side while twisting around the inside of the fitting until the entire 360 degree surface is completed. In contrast, the modified brush of the instant invention rotates completely at relatively high rate (in the range of 2,000 to 5,000 RPM). Once the brush becomes worn so that an interference fit no longer exists, the user only has to hold the modified brush toward the side of the fitting and roll the brush around 360 degrees in order to extend the useful life of the brush all the way to the stem.

The invention will be described for the purposes of illustration only in connection with certain embodiments; however, it is to be understood that other objects and advantages of the present invention will be made apparent by the following description of the drawings according to the present invention. While a preferred embodiment is disclosed, this is not intended to be limiting. Rather, the general principles set forth herein are considered to be merely illustrative of the scope of the present invention and it is to be further understood that numerous changes may be made without straying from the scope of the present invention.

DETAILED DESCRIPTION OF THE PREFERRED EMBODIMENTS

The present invention is directed to a rotary abrasion device useful for brushing and reaming metal products such as copper tubing. The rotary abrasion device includes three primary embodiments with several variations within the same underlying concept. Specifically, each embodiment is designed to be attached to a power tool, whether such power tool includes a keyed chuck or is otherwise keyless. A feature common to each embodiment is an axial shaft in the form of a shank that is hexagonal in cross-section. Further in common, is an abrasive element in the preferred form of a metal-bristle brush. Each embodiment of the rotary abrasion device is rotated by the given power tool and abrasion occurs as the metal product is engaged with, and is held stationary relative to, the rotary abrasion device. In a preferred embodiment of the present invention, a balanced set of brushes are arranged around a central reaming element. During use, the brushes are biased towards the section of tubing being abraded by way of a brush adjustment arrangement. In an alternate embodiment of the instant invention, the central reaming element is not used. In another alternative embodiment of the instant invention, the rotary abrasion device is formed by a singular brush without a reaming element and without a brush adjustment arrangement. These three primary embodiments and the variations thereof are discussed in more detail hereinbelow with respect to the drawings.

Figure 1:
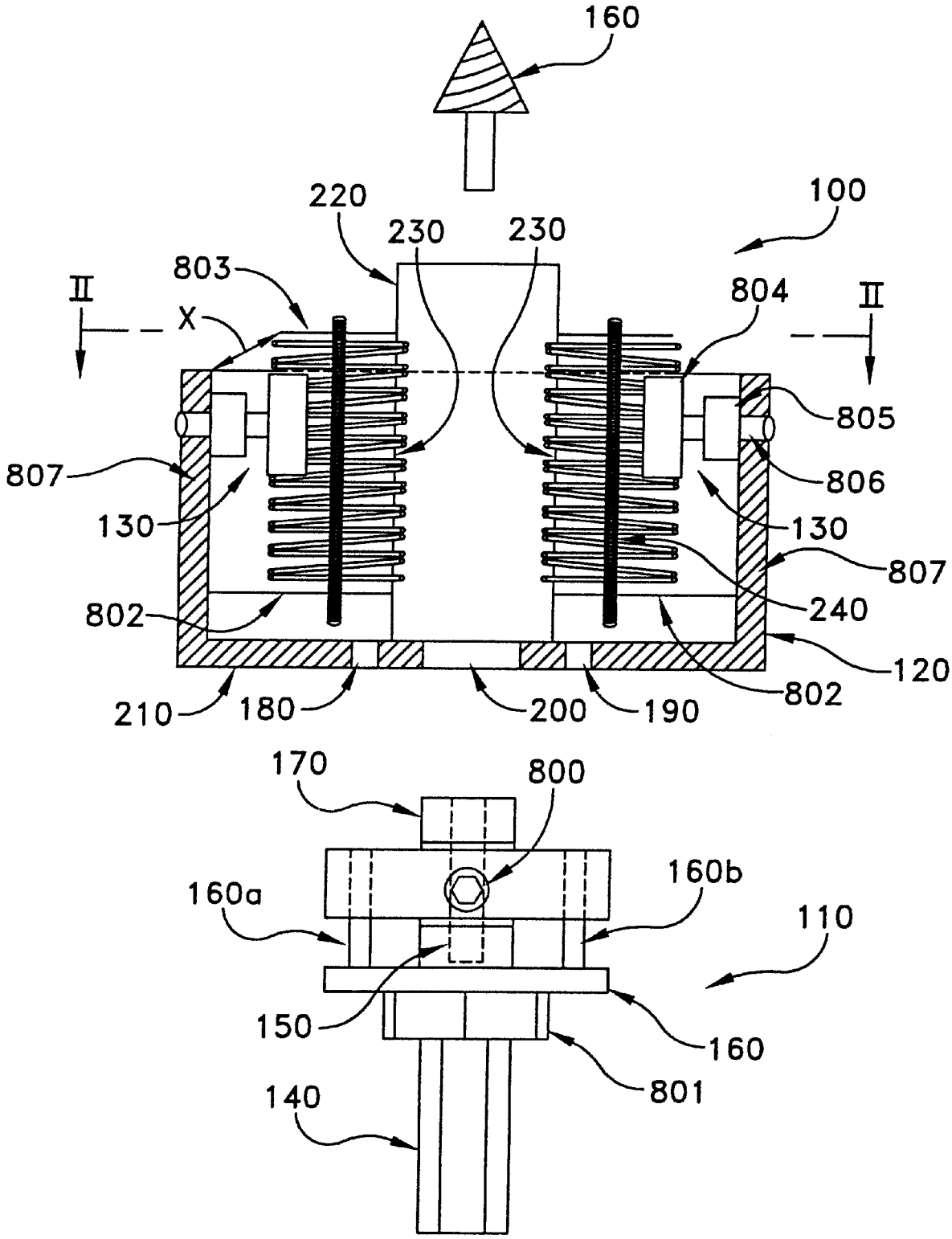
FIG. 1 is an exploded view of the rotary abrasion device according to the first preferred embodiment of the invention shown with a first type of reamer.

Referring now to FIG. 1, there is shown an exploded view of a first preferred embodiment of the present invention. In FIG. 1, a rotary abrasion device 100 is shown including a base section 110, a brush support section 120, and a brush adjustment arrangement 130. The base section 110 is in the form of an arbor having a hex shank 140 designed to be insertable into a keyed chuck or hex socket of a power tool (not shown). While not shown, for ease of manufacture, it may be preferable to form the rotary abrasion device 100 where the base section 110 is integrally cast from a durable metal alloy instead of being a separate arbor. Along the central axis of the base section 110, there is located a reamer-socket 150. The reamer-socket 150 is threaded to accept a variety of reamers (discussed in more detail below). One such reamer 160 is shown in FIG. 1 and kept in place by hex-screw 800. The arbor that forms the base section 110 also includes a lug platform 160 with a hex-nut 801 for securing the lug platform 160 to brush support section 120. Lugs 160*a* and 160*b* as well as a threaded shaft 170 accomplish alignment and fastening. These elements 160*a*, 160*b*, and 170 fit into respective openings 180, 190, and 200 located on the base 210 of the brush support section 120.

Figure 2:
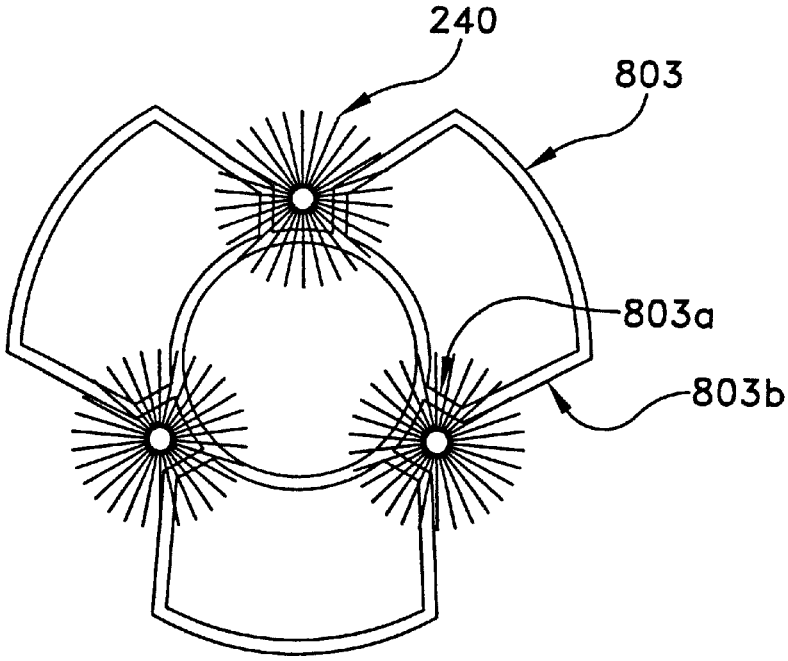
FIG. 2 is a cross-sectional top view taken along the line II—II of the invention as shown in FIG. 1.
Figure 3:
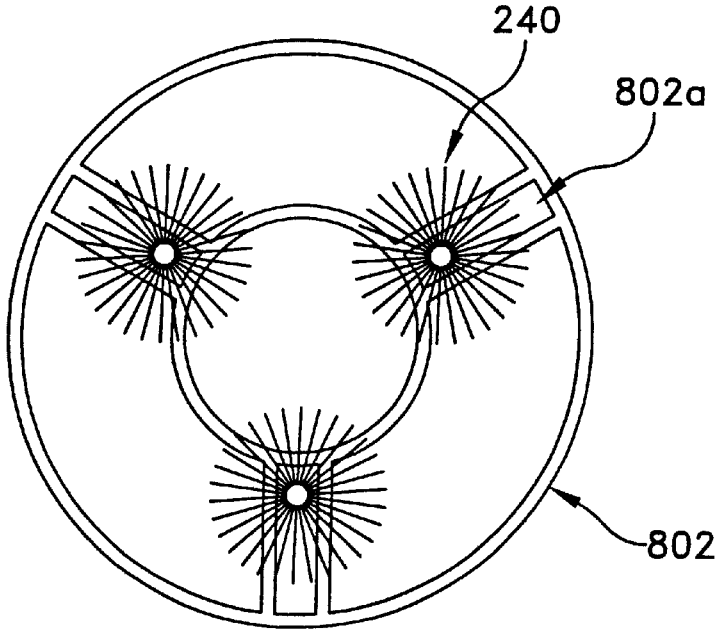
FIG. 3 is a lower disk of the rotary abrasion device as shown in FIG. 1.
Figure 12:
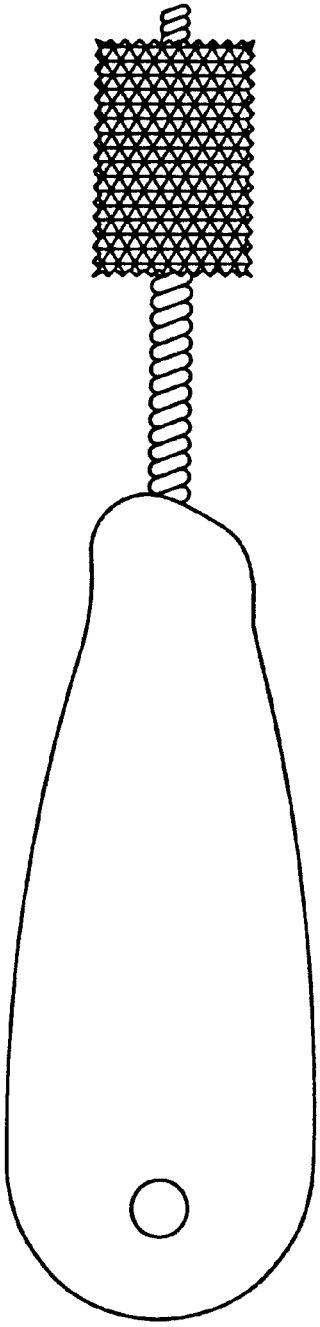
FIG. 12 (PRIOR ART)
FIG. 12 is a perspective view of a prior-art manual brush.

With respect to the brush support section 120, the base 210 is formed with an inner sleeve 220. The inner sleeve 220 is elongated along the central longitudinal axis of the rotary abrasion device 100 and preferably protrudes beyond the plane formed by line II—II. By extending the inner sleeve 220 up to one inch or more, this allows any inserted workpiece (i.e., tubing) to be well supported by the entire length of the inner sleeve 220. Surrounding the inner sleeve 220 are brushes 240. The brushes are preferably new with a full measure of bristles thereupon. While using new brushes extends the use between required brush replacements, it may be preferable in many situations to utilize old, worn, and normally-discarded conventional manual brushes by cutting off the handle of each (see FIG. 12). The brushes 240 are each attached between a lower disk 802 and an upper disk 803. As shown in FIGS. 2 and 3, the upper disk 803 and the lower disk 802 have slots 803*a* and 802*a*, respectively, that accept the wire ends of each brush 240. This allows each brush 240 to slide radially inwards and outwards. The slot 803*a* of the upper disk 803 is shorter than in the lower disk 802 and includes an angled section 803*b*. This angled section 803*b* helps channel initial placement of each brush 240 while the slots 803*a* and 802*a* prevent brush 240 movement during rotation of the rotary abrasion device 100.

The inner sleeve 220 is in the form of a cylinder that includes multiple apertures 230. The number of apertures 230 may form any symmetrical arrangement. However, for optimal abrasion and balance, it is preferred that three brushes 240 and three apertures 230 be used as shown. Each aperture 230 is large enough to allow a large section of each brush 240 to protrude therethrough. In order for each brush 240 to protrude through each aperture 230, a brush adjustment arrangement 130 exists.

With continued reference to FIG. 1, the brush adjustment arrangement 13 that is shown includes a curved brush brace 804, a fixed-nut 805, and a brush-adjustment screw 806. The fixed-nut 805 is attached to the sidewall 807 of the brush support 120. Each brace 804 is adjusted against each respective brush 240 by way of each screw 806. Each brace 804 may also include a brace support (not shown) that would allow each brace 804 to easily slide in and out of position. In order to remove/replace brushes 240, each screw 806 is rotated so as to move each brace 804 away from each brush 240. This allows each brush 240 to be pulled out if and into position via the space X. While all materials used are preferably of a durable metal alloy, suitably durable plastic may also be used without straying form the intended scope of the present invention. Once the brush support section 120 is affixed to (or integrally formed with) the base section 110 and the reamer 160 is in place, the brush adjustment arrangement 130 is slid into place around the brushes 240. The screw 260 is then sufficiently tightened so as to push a portion of each brush 240 through each aperture 230 in the inner sleeve 220. In this manner, initial brush adjustment is accomplished. As well, subsequent brush adjustment is accomplished similarly when the brushes begin to wear during use.

Figure 1A:
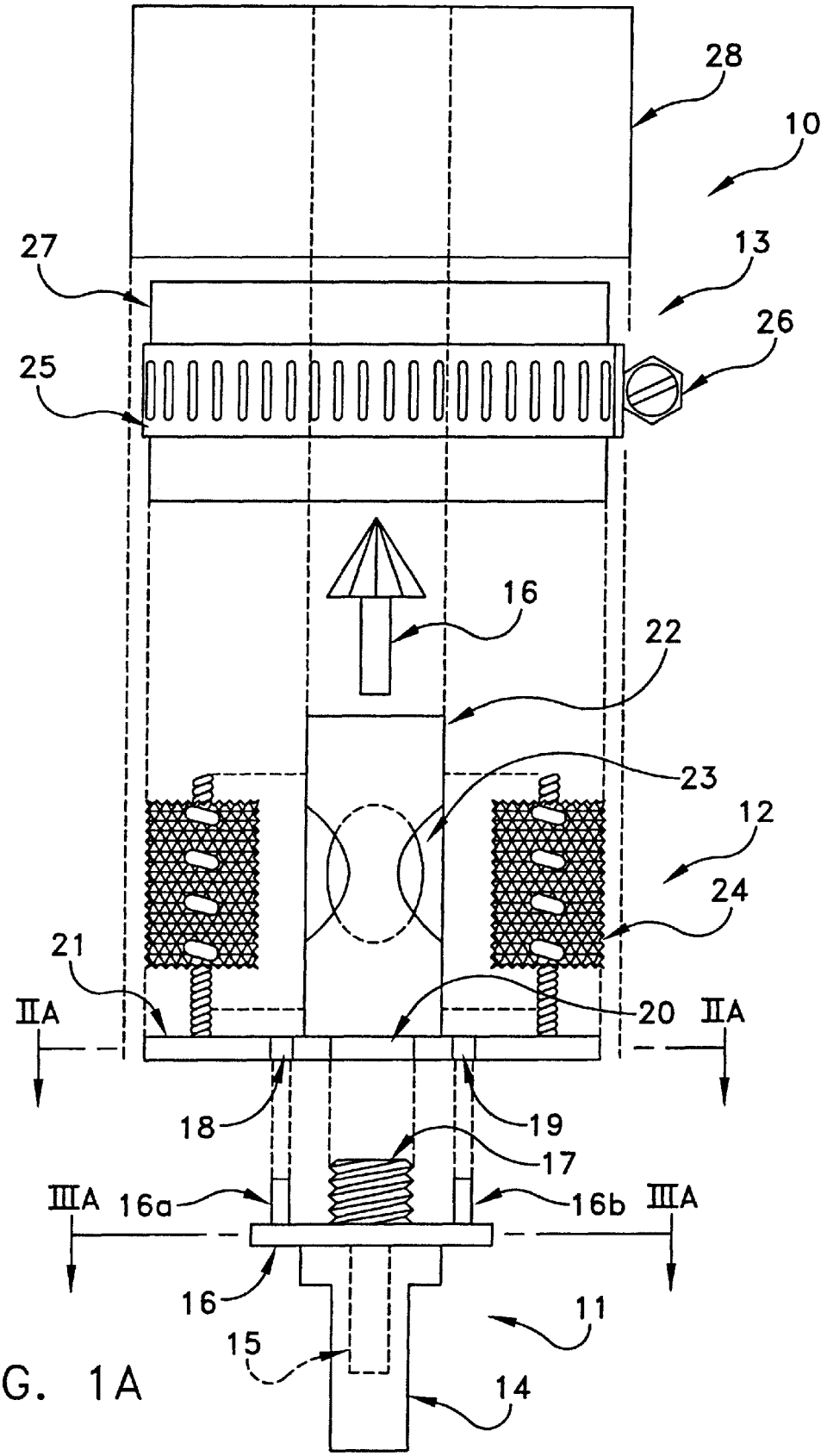
FIG. 1A is an exploded view of the rotary abrasion device according to an alternative embodiment of the invention shown in FIG. 1.
Figure 2A:
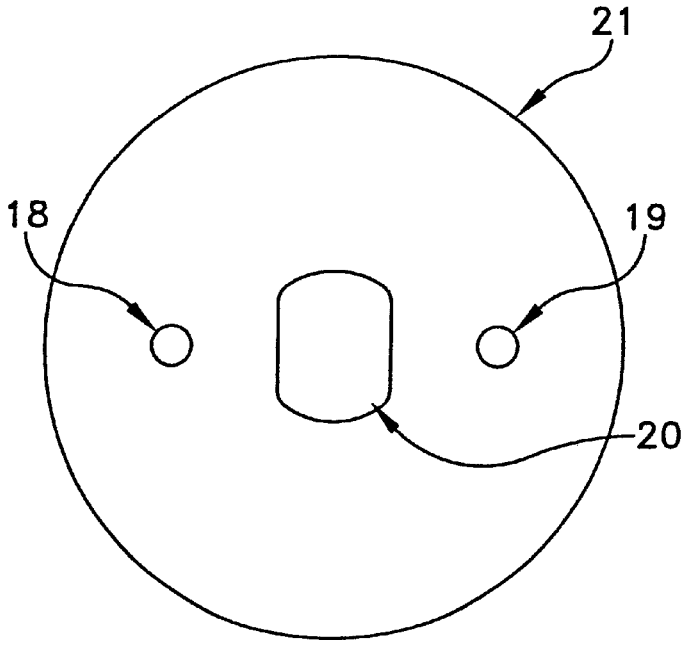
FIG. 2A is a cross-sectional top view taken along the line IIA—IIA of the invention as shown in FIG. 1A.
Figure 3A:
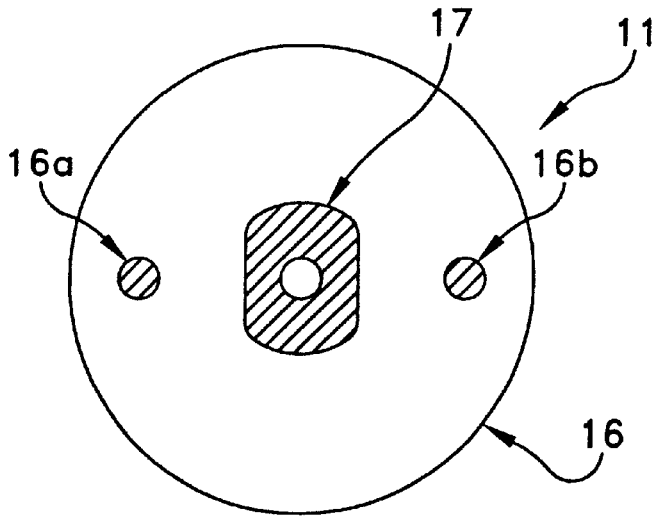
FIG. 3A is a cross-sectional top view taken along the line IIIA—IIIA of the invention as shown in FIG. 1A.

Referring now to FIG. 1A, there is shown an exploded view of a preferred embodiment of the present invention. In FIG. 1A, a rotary abrasion device 10 is shown including a base section 11, a brush support section 12, and a brush adjustment arrangement 13. Within the base section 11, a hex shank 14 is included to be insertable into a keyed chuck or hex socket of a power tool (not shown). Preferably, the base section 11 is integrally cast from a durable metal alloy. However, manufacture by any existing method of machining a solid metal workpiece is also possible so long as the end product is sufficiently durable. Along the central axis of the base section II, there is located a reamer-socket 15. The reamer-socket 15 is threaded -to accept a variety of reamers (discussed in more detail below). One such reamer 16 is shown in FIG. 1. The base section 11 also includes a seat 16 for securing the brush support section 12. Lugs 16*a* and 16*b* as well as a keyed shaft 17 are located on the seat 16. These elements 16*a*, 16*b*, and 17 fit into respective openings 18, 19, and 20 located on the base-plate 21 of the brush support section 12. FIGS. 2A and 3A show the mating shapes of elements 16*a*, 16*b*, and 17 and the respective openings 18, 19, and 20.

With respect to the brush support section 12, the base-plate 21 is formed with an inner sleeve 22. The inner sleeve 22 is elongated along the central longitudinal axis of the rotary abrasion device 10. This allows any inserted workpiece (i.e., tubing) to be supported by the entire length of the inner sleeve 22. Surrounding the inner sleeve 22 are brushes 24. The brushes are preferably new with a full measure of bristles thereupon. While using new brushes extends the use between required brush replacements, it may be preferable in many situations to utilize old, worn, and normally-discarded conventional manual brushes by cutting off the handle of each (see FIG. 12). The brushes 24 are each attached to the baseplate 21. As shown, the brushes 24 are permanently affixed to the baseplate 21 by some known method such as welding. However, it may be preferable to mount each brush 24 in such a way that each brush 24 is radially slidable towards the inner sleeve 22. This could be accomplished by movably mounting each brush 24 within a respective radially oriented slot (not shown) in the baseplate 21. The inner sleeve 22 is in the form of a cylinder that includes multiple oval-shaped apertures 23. Each aperture 23 is large enough to allow a large section of each brush 24 to protrude therethrough. In order for each brush 24 to protrude through each aperture 23, a brush adjustment arrangement 13 exists.

With continued reference to FIG. 1, the brush adjustment arrangement 13 that is shown includes an adjustable band 25, an adjustment screw 26, and a flexible sheet 27. The band 25 and screw 26 are preferably of the type of common adjustable metal bands that reduce their diameter by using a standard screwdriver. However, suitably durable plastic banding may also be used without straying form the intended scope of the present invention. The flexible sheet 27 is preferably a thin rectangular section of sheetmetal that is rolled into a loose cylinder with overlapping ends to allow adjustment by the band 25 and screw 26. Once the brush support section 12 is affixed to the base section 11 and the reamer 16 is in place, the brush adjustment arrangement 13 is slid into place around the brushes 24. The screw 26 is then sufficiently tightened so that the band 25 constricts the flexible sheet 27. Tightening continues until the constricted flexible sheet 27 comes into contact with the brushes 24 and subsequently pushes a portion of each brush 24 through each aperture 23 in the inner sleeve 22. In this manner, initial brush adjustment is accomplished. As well, subsequent brush adjustment is accomplished similarly when the brushes begin to wear during use.

To protect the aforementioned structures, a cover 28 may be used. The cover is preferably a metallic cylindrical cap with a central opening that matches the given dimension of the inner sleeve 22. However, a high impact plastic cap with such a central opening may also be suitable. The cover 28 is either attached to the baseplate 21 by way of mating threads, by way of a snap-fit, or any other suitable method that would allow easy removal and access to the aforementioned inner workings for brush adjustment. As FIGS. 1 and 1A–3A account for the basic structure of the present invention, these figures should be kept in mind during the discussion of the possible various modifications with respect to FIGS. 4–15 as follows.

Figure 4:
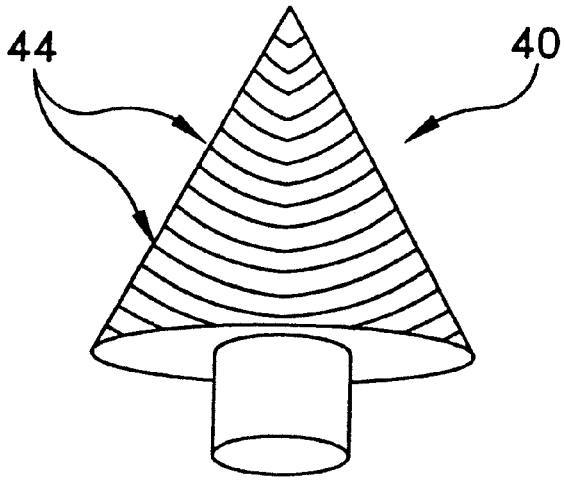
FIG. 4 is a side-perspective view of a second type of reamer usable within the present invention shown in FIG. 1A.
Figure 6:
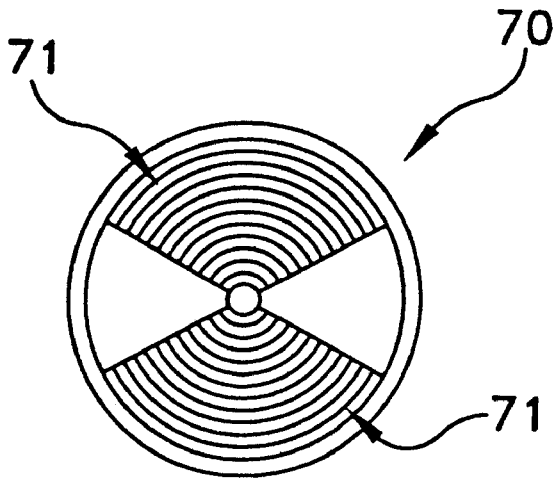
FIG. 6 is an end view of a third type of reamer usable within the present invention shown in FIG. 1A.
Figure 7:
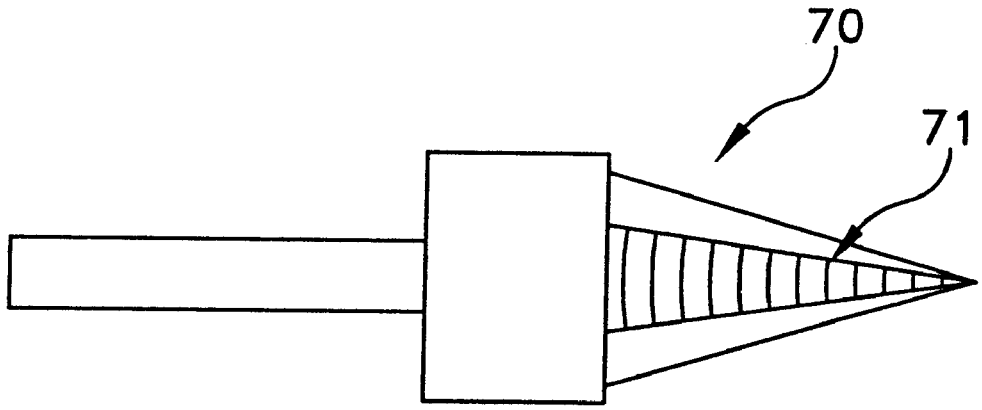
FIG. 7 is a side-perspective view of the third type of reamer as shown in FIG. 6.

FIGS. 4 and 6–9 are variations on the reamer 16 as shown in FIG. 1. As noted above, the rotary abrasion device 10 may function with or without such reaming elements. However, it has been found that the overall usefulness of the present invention is greatly enhanced by the presence of such reaming elements. FIG. 4 shows a second reamer 40 having curved bevel-cuts 41 to enable removal of surface irregularities of the given tubing's inner edge. FIGS. 6 and 7 show an end-view and a side view, respectively, of a third reamer 70. This reamer 70 has been found to be ideal for use with ¾" copper tubing of both the L-type and M-type. Such differing types are also referred to in the industry as "grades" of tubing. The outside diameters of both L and M type tubing is the same (i.e., ⅞"). However, the inside diameters differ. Both types are commonly referred as ¾" plumbing, but the L-type has significantly thicker walls that are heavy and durable. L-type is used mostly for domestic water supplies. Whereas, M-type tubing is several thousandths of an inch thinner than L-type and is used widely in the heating industry. This particular use of M-type tubing is because the thinner walls conduct heat better than L-type and such use does not subject M-type to the same level of corrosive minerals and similar agents as within a domestic water supply. Preferably, this reamer 70 includes fluting 71 in a balanced double-flute arrangement of curved bevel-cuts. Further, this reamer 70 is useful for another type of ¾" copper pipe called K-type which is thicker even than L-type. K-type is a flexible tubing used almost exclusively underground (e.g., water mains, . . . etc.) and is found in rolls of differing lengths.

Figure 8:
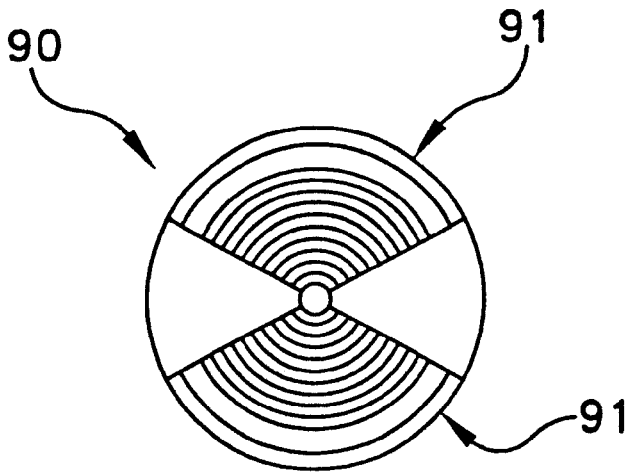
FIG. 8 is an end view of a fourth type of reamer usable within the present invention shown in FIG. 1A.
Figure 9:
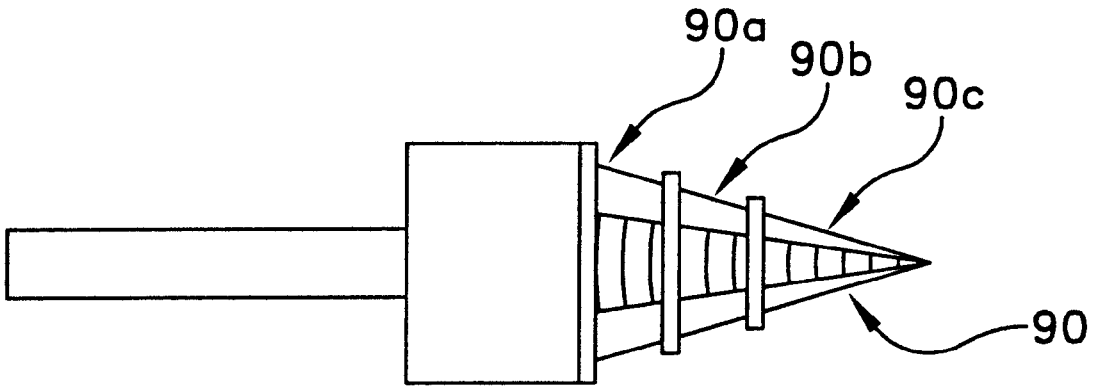
FIG. 9 is a side-perspective view of the fourth type of reamer as shown in FIG. 8.

FIGS. 8 and 9 show an end-view and a side view, respectively, of a step reamer 90. The step reamer 90 includes a similar fluting 91 as that mentioned with respect to FIGS. 6 and 7. However, the step reamer 90 also includes indexed tiers 90*a*, 90*b*, and 90*c*. The step reamer 90 is an ideal reamer for use with the aforementioned different types (grades) of copper tubing designated with the letters K, L, and M. With reference to FIG. 9, it is noted that indexed tiers 90*a*, 90*b*, and 90*c* correlate, respectively, with the different inside diameters of K-type, L-type, and M-type tubing. By providing the physical breaks between the indexed tiers 90*a*, 90*b*, and 90*c*, the step reamer 90 provides accurate reaming of only the given type of tubing. That is to say, the indexed tiers 90*a*, 90*b*, and 90*c* prevent over-reaming the tubing end. For instance, an L-type tube will only fit onto the step reamer 90 up to the indexed tier 90*c*. This prevents widening of the given tubing beyond what is preferred. While K, L, and M type tubing is described, it should be clear that standards may change and different types, grades, and diameters may be in use. Accordingly, the dimensions of the indexed tiers 90*a*, 90*b*, and 90*c* may be varied without straying from the intended scope of the present invention.

Figure 5:
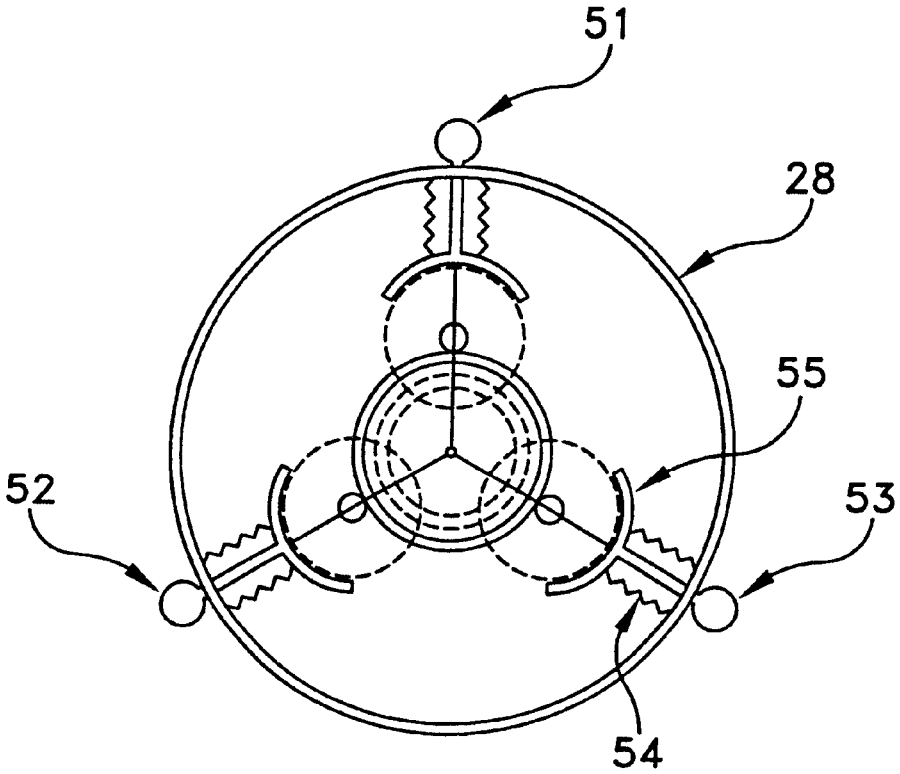
FIG. 5 is a top view of the invention shown in FIG. 1A but having an alternative brush adjustment arrangement using spring elements.
Figure 10:
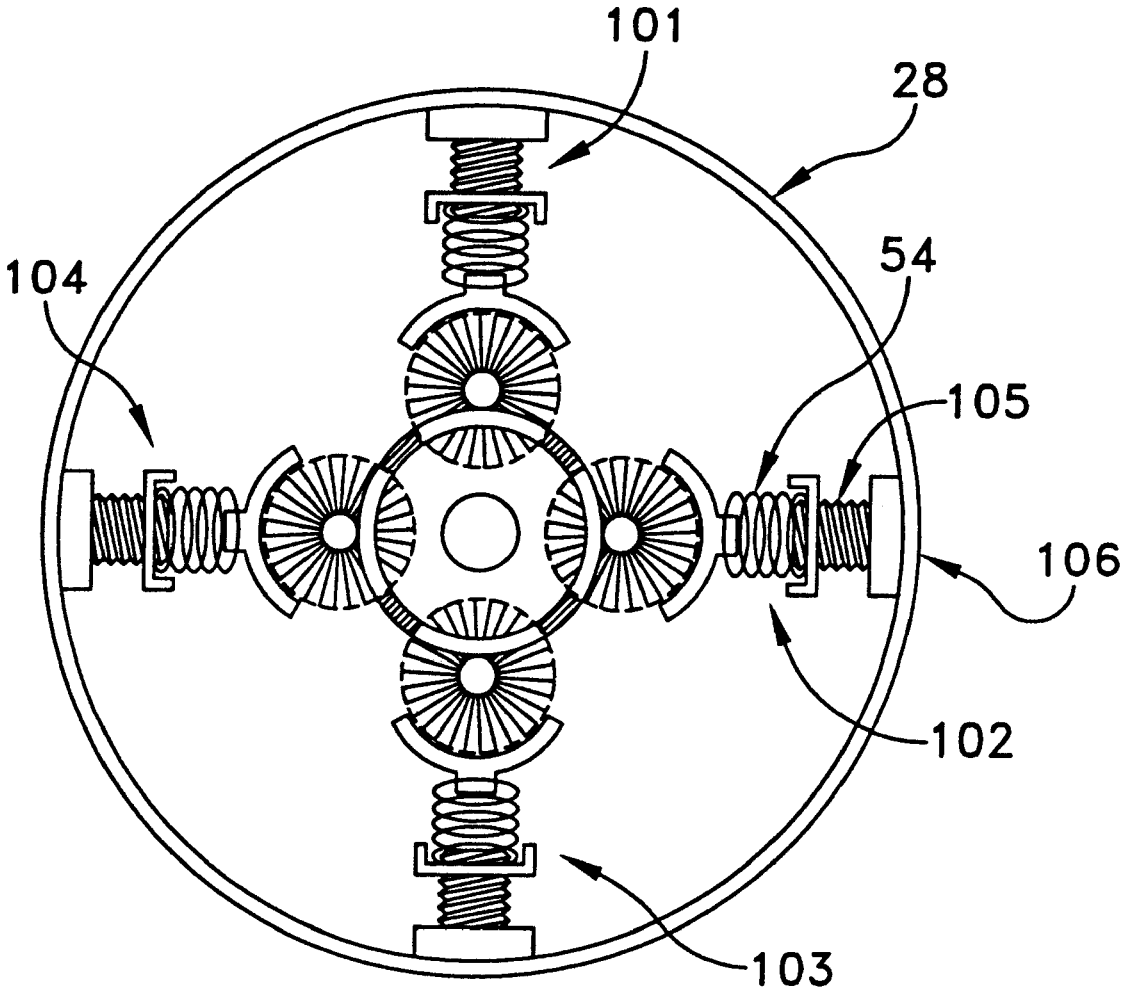
FIG. 10 is a top view of the invention shown in FIG. 1A but having an alternative brush adjustment arrangement using spring and screw elements
Figure 11:
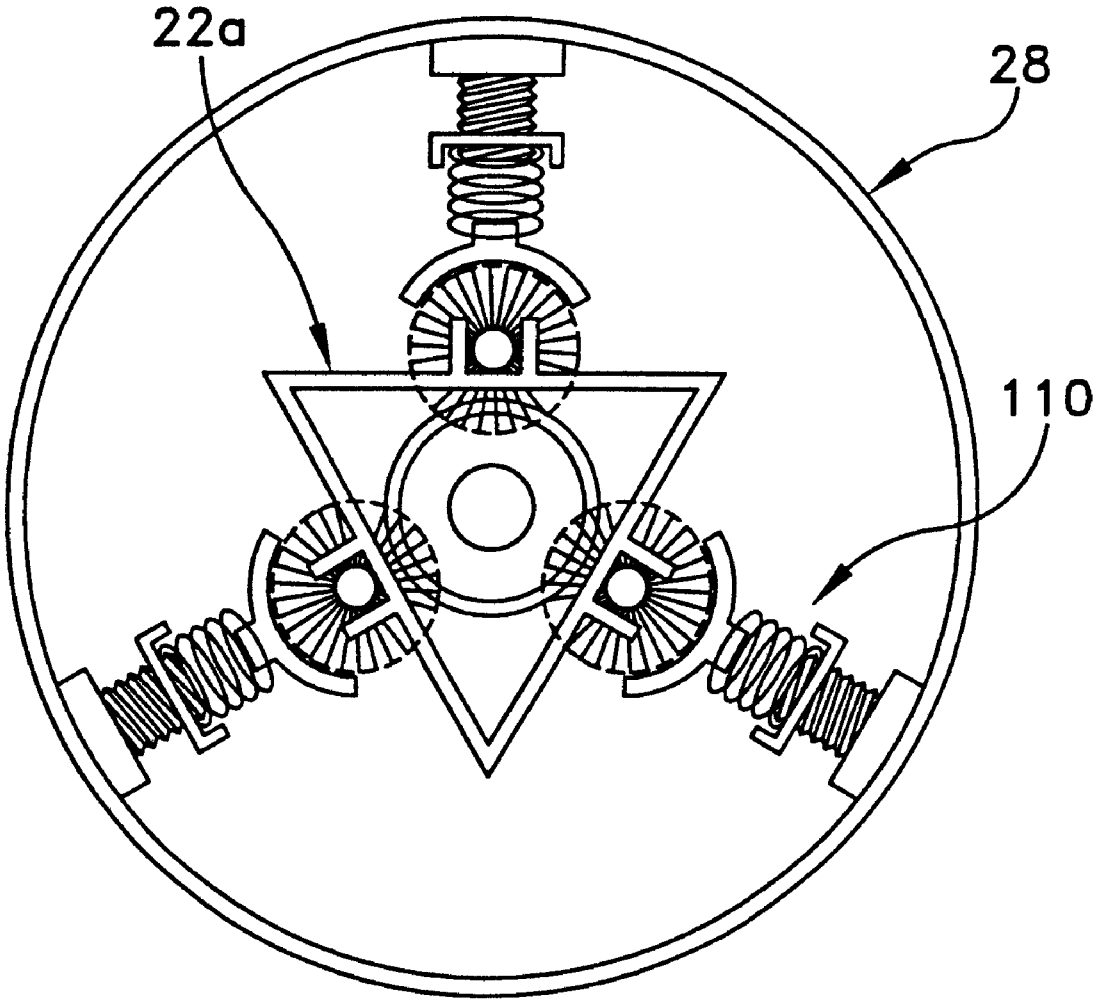
FIG. 11 is a top view of the invention shown in FIG. 1A but utilizing only three brushes and having an alternative brush adjustment arrangement using spring and screw elements.

With reference to FIGS. 5, 10, 11, 14, and 15, certain variations of the brush adjustment arrangement 13 as shown in FIG. 1A will now be discussed. In FIG. 5, spring elements 51, 52, and 5 are used in place of the brush adjustment arrangement 13 shown in FIG. 1A. Each of these spring elements 51, 52, and 53 include a compression spring 54 and a curved brush brace 55. The spring 54 is arranged so as to bias the brace 55 against the cover 28. This automatically maintains each brush (shown in silhouette by hidden lines) in place within their respective aperture. FIG. 10 shows a four-brush version of the present invention that includes springscrew elements 101, 102, 103, and 104 that differ from the spring elements 51, 52, and 53 of FIG. 5 by way of the addition of screws 105. These screws 105 are located on each springscrew element 101, 102, 103, and 104 and are adjusted via an opening within the cover 28. By tightening each screw 105, the compression of each spring 54 can be increased. FIG. 11 shows a three-brush design that includes a springscrew 110. However, FIG. 11 illustrates the option of changing the shape of the inner sleeve 22*a* from cylindrical to prismoidal. Rather than merely a cosmetic change, this particular shape has been found to maintain the cover in place through the "keying" effect of the triangular cross-section. As well, the resulting brush exposure through the apertures is maximized through this design.

Figure 13:
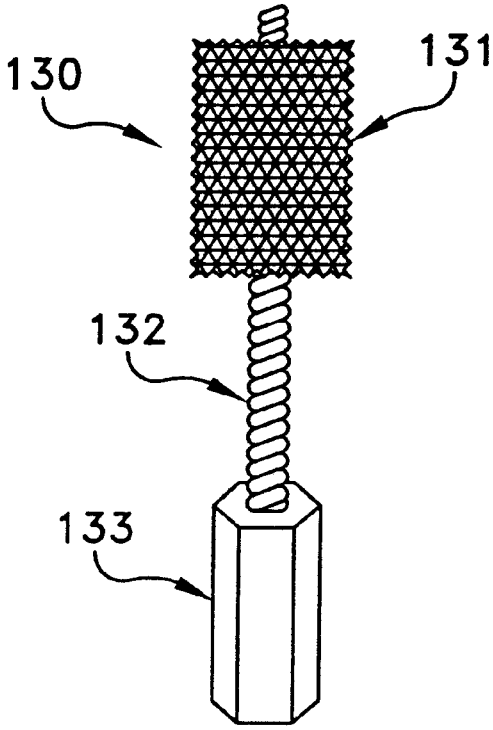
FIG. 13 is a perspective view of another embodiment of the rotary abrasion device according to the present invention.

FIG. 13 shows another embodiment according to the present invention. In an alternative, simplified version, FIG. 13 shows a rotary abrasion device 130 that includes a brush 131, a brush stem 132, and a hex shank 133. Preferably, the hex shank 133 is cast from a titanium alloy or some suitably durable metal such as, but not limited to steel or lead, tin or zinc alloys. In operation, the hex shank 133 around the brush stem 132 enables the brush 131 to be inserted into any existing drill chuck. In sharp contrast to the prior-art manual brush shown in FIG. 12, the rotary abrasion device 130 would increase the speed of cleaning, as well as extend the useful life of the brush 131 much longer than the prior-art hand-held brushes.

Figure 14:
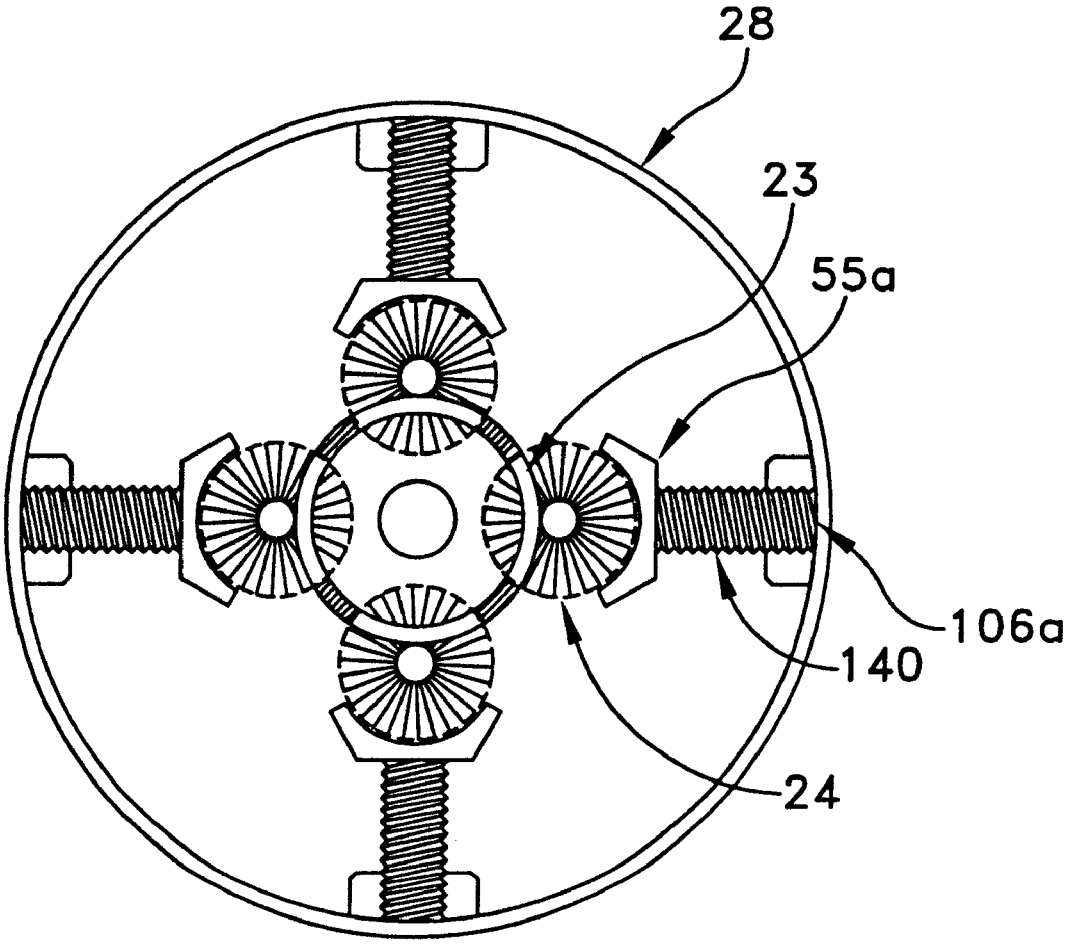
FIG. 14 is a top view of the invention shown in FIG. 1A but having an alternative brush adjustment arrangement using jackscrew elements.
Figure 15:
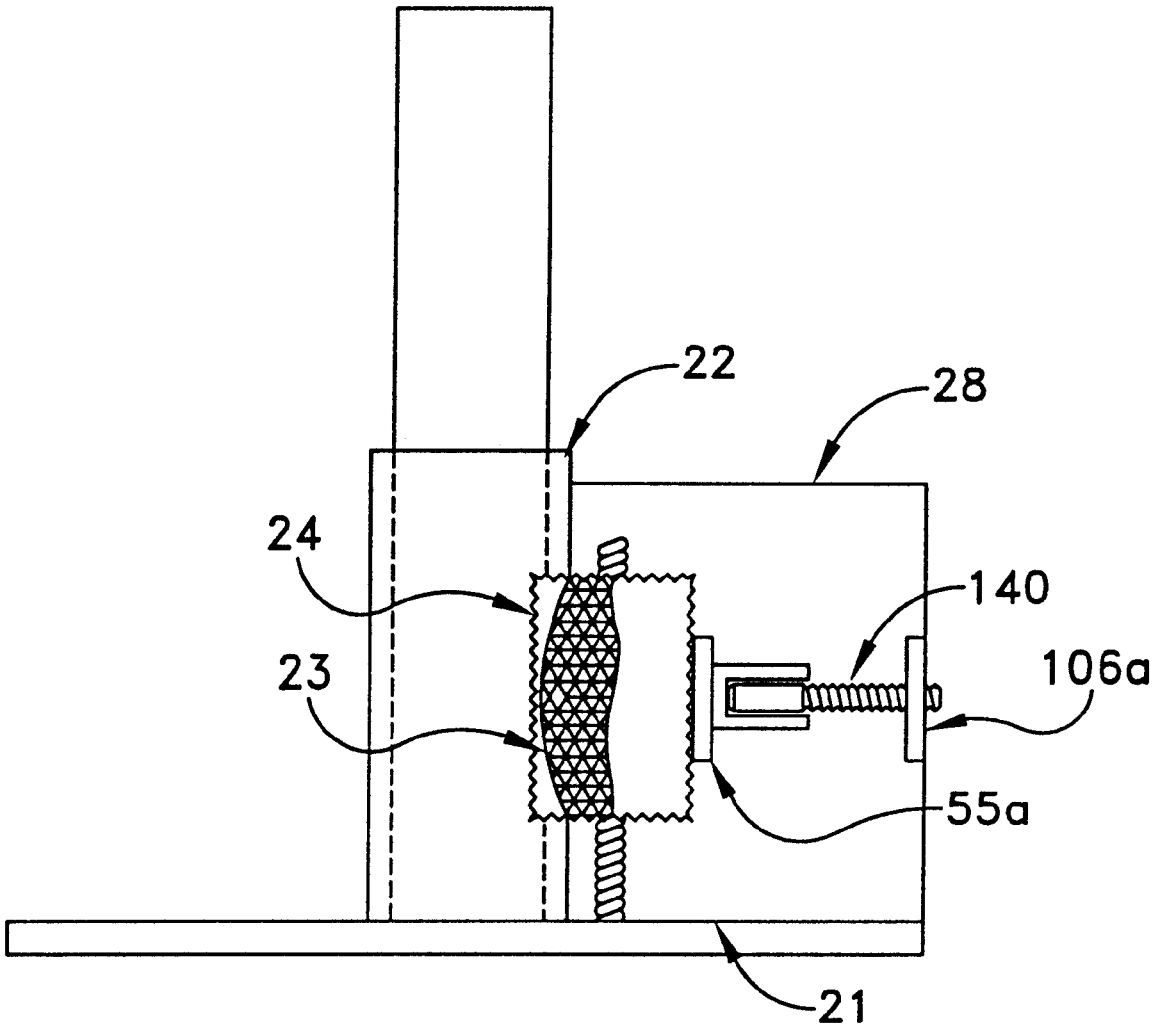
FIG. 15 is a partial side-view of the invention shown in FIG. 14 detailing one jackscrew element.

FIGS. 14 and 15 are similar to FIGS. 10 and 11 except that no springs are used. Instead, adjustment screws in the form of jackscrews 140 are used to force each brush through the respective aperture 23. As before, an opening 106*a* in the cover 28 allows a user to adjust each jackscrew 140 with a suitable type of screwdriver. For clarity of illustration, FIG. 15 shows a cross-section of the aforementioned elements.

It should be understood that the preferred embodiments mentioned here are merely illustrative of the present invention. Numerous variations in design and use of the present invention may be contemplated in view of the following claims without straying from the intended scope and field of the invention herein disclosed.

I claim:

1. A rotary abrasion device for surface preparation of a tubular metallic element, said rotary abrasion device comprising:

a base section designed to be attached to a power tool, said base section having a central longitudinal axis with a first end and a second end, said first end being a shank of hexagonal cross-section, said second end of said base section including a shaft located along said central longitudinal axis and at least one lug located adjacent said shaft;

a brush support section connected to said base section, said brush support section including a baseplate and an inner sleeve located along said central longitudinal axis and perpendicular to said baseplate, said baseplate having an openings therein that substantially match cross-sections of said shaft and said lug, said inner sleeve including at least two substantially oval-shaped apertures, said inner sleeve being hollow and sized appropriately to accept a tubular metallic element, said inner sleeve having an inner diameter slightly greater than said tubular metal element;

a brush element including at least two brushes mounted adjacent to said apertures of said inner sleeve; and a brush adjustment arrangement peripherally located around said brushes, said brush adjustment arrangement being designed to force said brushes substantially through said apertures within said inner sleeve so as to come into contact with said tubular metallic element;

wherein upon attachment to said power tool, said brush element is rotatable via said power tool; and wherein upon engagement of said tubular metallic element with said rotary abrasion device, and said tubular metallic element being held stationary relative to said rotary abrasion device, said tubular metallic element is abraded by said rotary abrasion device.

2. A The rotary abrasion device as claimed in claim 1, wherein said brush adjustment arrangement includes a flexible rectangular sheet that forms a cylinder that surrounds said inner sleeve and said brushes, an adjustable band centrally located around said cylinder, and a screw for adjusting said adjustable band such that tightening said screw constricts said adjustable band and subsequently decreases the diameter of said cylinder so that said brushes are forced through said apertures towards said central longitudinal axis, and said rotary abrasion device also includes a cover in the form of a cylindrical cup having a central opening to allow passage of said tubular metallic element therethrough, said cover being secured to said baseplate and substantially enclosing said brush support section.

3. The rotary abrasion device as claimed in claim 1, said rotary abrasion device also including a cover in the form of a cylindrical cup having a central opening to allow passage of said tubular metallic element therethrough, said cover being secured to said baseplate and substantially enclosing said brush support section, wherein said brush adjustment arrangement includes a spring element for each of said brushes, each said spring element being centrally located around said cover and adjacent each of said brushes and having a brush brace, an expansion spring, and a spring guide, said brush brace is curved to match the general shape of each of said brushes, said expansion spring surrounds said spring guide and creates an expansion force between an inner surface of said cover and said brush brace so that said brushes are forced through said apertures of said inner sleeve towards said central longitudinal axis.

4. The rotary abrasion device as claimed in claim 1, said rotary abrasion device also including a cover in the form of a cylindrical cup having a central opening to allow passage of said tubular metallic element therethrough, said cover being secured to said baseplate and substantially enclosing said brush support section, wherein said brush adjustment arrangement includes a springscrew for each of said brushes, each said springscrew being centrally located around said cover and adjacent each of said brushes and having a brush brace, an expansion spring, and a jackscrew, said brush brace is curved to match the general shape of each of said brushes, said expansion spring being attached to said brush brace and to said jackscrew and creating an expansion force therebetween so that said brushes are forced through said apertures of said inner sleeve towards said central longitudinal axis, wherein said jackscrew passes through said cover and is adjustable from outside said cover such that tightening said jackscrew compresses said expansion spring.

5. The rotary abrasion device as claimed in claim 1, wherein said brush adjustment arrangement includes an adjustment screw and a brush brace in paired arrangement such that a pair exists for each of said brushes, each said pair being centrally located adjacent each of said brushes, said brush brace being curved to support each of said brushes, said adjustment screw being movably attached to said brush brace and threadingly attached to said brush support section, each said adjustment screw passing through said brush support section and being adjustable from outside of said brush support section such that tightening said adjustment screws forces said brush braces against said brushes so that said brushes are forced through said apertures of said inner sleeve towards said central longitudinal axis.

6. The rotary abrasion device as claimed in claim 1, wherein said shaft of said base section includes a hollow section aligned with said central longitudinal axis and extending into said shank, said hollow section being female threaded, and said rotary abrasion device also includes a step reamer having a male threaded base for acceptance into said hollow section, said step reamer having longitudinal fluting and three indexed tiers, each said indexed tier having diameters correlating, respectively, with differing inside diameters of K-type, L-type, and M-type tubing.

7. The rotary abrasion device as claimed in claim 2, wherein said shaft of said base section includes a hollow section aligned with said central longitudinal axis and extending into said shank, said hollow section being female threaded, and said rotary abrasion device also includes a step reamer having a male threaded base for acceptance into said hollow section, said step reamer having longitudinal fluting and three indexed tiers, each said indexed tier having diameters correlating, respectively, with differing inside diameters of K-type, L-type, and M-type tubing.

8. The rotary abrasion device as claimed in claim 3, wherein said shaft of said base section includes a hollow section aligned with said central longitudinal axis and extending into said shank, said hollow section being female threaded, and said rotary abrasion device also includes a step reamer having a male threaded base for acceptance into said hollow section, said step reamer having longitudinal fluting and three indexed tiers, each said indexed tier having diameters correlating, respectively, with differing inside diameters of K-type, L-type, and M-type tubing.

9. The rotary abrasion device as claimed in claim 4, wherein said shaft of said base section includes a hollow section aligned with said central longitudinal axis and extending into said shank, said hollow section being female threaded, and said rotary abrasion device also includes a step reamer having a male threaded base for acceptance into said hollow section, said step reamer having longitudinal fluting and three indexed tiers, each said indexed tier having diameters correlating, respectively, with differing inside diameters of K-type, L-type, and M-type tubing.

10. The rotary abrasion device as claimed in claim 5, wherein said shaft of said base section includes a hollow section aligned with said central longitudinal axis and extending into said shank, said hollow section being female threaded, and said rotary abrasion device also includes a step reamer having a male threaded base for acceptance into said hollow section, said step reamer having longitudinal fluting and three indexed tiers, each said indexed tier having diameters correlating, respectively, with differing inside diameters of K-type, L-type, and M-type tubing.

11. The rotary abrasion device as claimed in claim 6, wherein said rotary abrasion device includes exactly three of said brushes and said inner sleeve is substantially prismoidal and includes exactly three of said apertures.

12. The rotary abrasion device as claimed in claim 7, wherein said rotary abrasion device includes exactly three of said brushes and said inner sleeve is substantially prismoidal and includes exactly three of said apertures.

13. The rotary abrasion device as claimed in claim 8, wherein said rotary abrasion device includes exactly three of said brushes and said inner sleeve is substantially prismoidal and includes exactly three of said apertures.

14. The rotary abrasion device as claimed in claim 9, wherein said rotary abrasion device includes exactly three of said brushes and said inner sleeve is substantially prismoidal and includes exactly three of said apertures.

15. The rotary abrasion device as claimed in claim 10, wherein said rotary abrasion device includes exactly three of said brushes and said inner sleeve is substantially prismoidal and includes exactly three of said apertures.

* * * * *